US005152124A

United States Patent [19]

Ishii et al.

[11] Patent Number: 5,152,124

[45] Date of Patent: Oct. 6, 1992

[54] APPARATUS FOR FILLING AND SEALING BAGS

[75] Inventors: Akira Ishii; Satoshi Mino; Shigehisa Shimizu; Kazuo Okutsu, all of Kanagawa, Japan

[73] Assignee: Fuji Photo Film Co., Ltd., Kanagawa, Japan

[21] Appl. No.: 736,339

[22] Filed: Jul. 26, 1991

[30] Foreign Application Priority Data

Jul. 27, 1990 [JP] Japan ..... 2-200918
Aug. 3, 1990 [JP] Japan ..... 2-206977

[51] Int. Cl.[5] ..... B65B 43/26

[52] U.S. Cl. ..... 53/570; 53/252; 53/284.7; 53/370.6; 53/372.5; 53/372.7

[58] Field of Search ..... 53/252, 258, 284.7, 53/370.6, 372.4, 372.5, 372.6, 372.7, 570

[56] References Cited

U.S. PATENT DOCUMENTS

| | | | |
|---|---|---|---|
| 2,154,715 | 4/1939 | Allison | 53/372.7 X |
| 2,626,495 | 1/1953 | Gaubert | 53/370.6 |
| 2,911,778 | 11/1959 | Ozor | 53/372.6 X |
| 3,115,736 | 12/1963 | Peterson | 53/370.6 |
| 3,483,668 | 12/1969 | Frost et al. | 53/252 X |
| 3,513,623 | 5/1970 | Pearson | 53/252 X |
| 3,603,059 | 9/1971 | Carnes et al. | 53/258 |
| 3,755,986 | 9/1973 | Hudson | 53/370.6 |
| 3,805,489 | 4/1974 | Lieder et al. | 53/370.6 |
| 4,011,708 | 3/1977 | Brown, Jr. | 53/284.7 X |
| 4,070,853 | 1/1978 | Sanders | 53/370.6 |

FOREIGN PATENT DOCUMENTS

| | | | |
|---|---|---|---|
| 902568 | 6/1972 | Canada | 53/252 |

*Primary Examiner*—John Sipos
*Assistant Examiner*—Daniel Moon
*Attorney, Agent, or Firm*—Sughrue, Mion, Zinn, Macpeak & Seas

[57] ABSTRACT

An apparatus for filling an article into a bag having an open end and a closed bottom includes an article insertion station which inserts an article into the bag through the open end thereof, an open end portion forming station which forms the open end portion of the bag into a predetermined shape, an open end portion folding station which folds the formed open end portion of the bag, and a conveyor which conveys the bag from a bag feeding station to the open end portion folding station through the article insertion station and the open end portion forming station in sequence. The conveyor conveys the bag with the open end of the bag directed transversely to the bag conveying direction of the conveyor and said article insertion station inserts the article in the direction transverse to the bag conveying direction of the conveyor.

10 Claims, 6 Drawing Sheets

APPARATUS FOR FILLING AND SEALING BAGS

BACKGROUND OF THE INVENTION

1. Field of the Invention

This invention relates to an apparatus for filling a solid article into a bag through an open end thereof and sealing the open end of the bag.

2. Description of the Prior Art

There has been known an apparatus for filling, folding and sealing bags in which while bags having an open end are conveyed by a conveyor, articles such as rolls of web material are inserted into the bag through the open end by a pusher, the open end portion of the bag is flattened into a predetermined shape, and the open end portion is folded a plurality of times. (See "Research Disclosure", P399, Jul., 1979, for instance.)

In the apparatus for filling, folding and sealing bags, the bag is placed on the conveyor so that the open end of the bag is directed in the bag conveying direction and the articles are moved in the direction opposite to the bag conveying direction when they are inserted into the bag, and the position of the bag is changed after insertion of the article so that the open end is directed transversely to the bag conveying direction. This is disadvantageous in that an additional positioning of the bag is required when the position of the bag is changed in order to automate the subsequent steps of flattening the open end portion of the bag and folding the flattened open end portion.

SUMMARY OF THE INVENTION

In view of the foregoing observations and description, the primary object of the present invention is to provide an apparatus for filling and sealing bags without changing the position of the bag.

In accordance with the present invention, there is provided an apparatus for inserting an article into a bag having an open end and a closed bottom comprising an article insertion station which inserts an article into the bag through the open end thereof, an open end portion forming station which forms the open end portion of the bag into a predetermined shape, an open end portion folding station which folds the formed open end portion of the bag, and a conveyor means which conveys the bag to the article insertion station, the open end portion forming station and the open end portion folding station in sequence, characterized in that said conveyor means conveys the bag with the open end of the bag directed transversely to the bag conveying direction of the conveyor means and said article insertion station inserts the article in the direction transverse to the bag conveying direction of the conveyor means.

DESCRIPTION OF THE PREFERRED EMBODIMENTS

Figure 1:
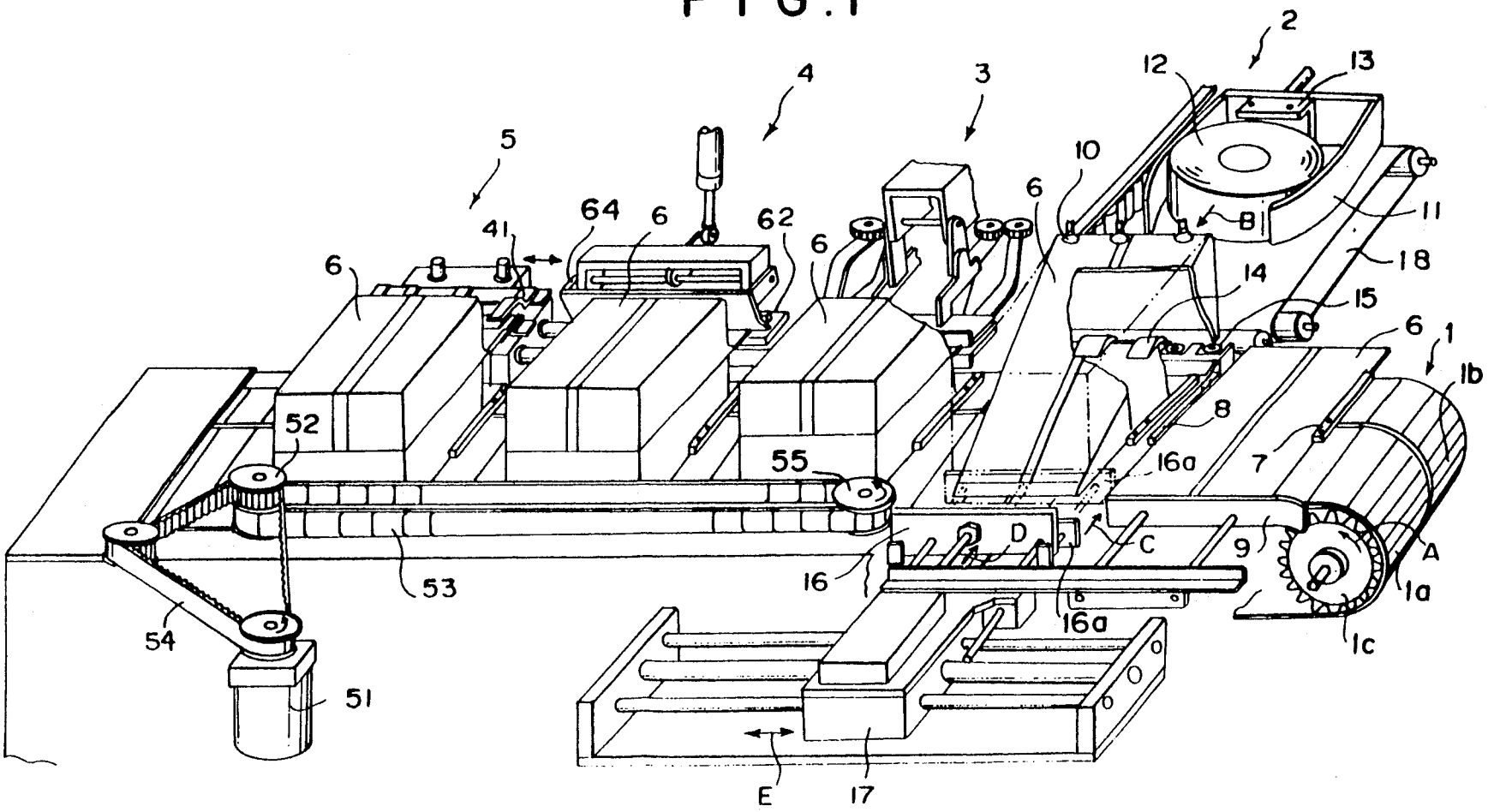
FIG. 1 is a schematic perspective view of an apparatus for filling and sealing bags in accordance with an embodiment of the present invention.

In FIG. 1, bags 6 are fed to a bucket conveyor 1 one by one at the right side end of the bucket conveyor 1. Each bag 6 is open at one end and is closed at the other end. The bucket conveyor 1 intermittently conveys each bag 6 through an article insertion station 2, an open end portion forming station 3, a first open end portion folding station 4 and a second open end portion folding station 5. The purpose of these stations will become apparent later.

The bucket conveyor 1 comprises a pair of flexible belts 1*a* and 1*b* which are arranged side by side and are driven in the same direction in synchronization with each other by a driving pulley 1*c*. A first side positioning guide 7 which abuts against the rear side (the right side as seen in FIG. 1) of the bag 6 and positions the rear side of the bag 6 is fixed to the belt 1*a*, and a second side positioning guide 8 which abuts against the front side (the left side as seen in FIG. 1) of the bag 6 and positions the left side of the bag 6 is fixed to the belt 1*b*. By moving the belts 1*a* and 1*b* in the longitudinal direction relative to each other, the space between side positioning guides 7 and 8 can be changed, whereby the bucket conveyor 1 can be conformed to bags having different widths. Further a bottom positioning guide 9 which is movable in the transverse direction of the bucket conveyor 1 abuts against the bottom of the bag 6 and positions the bottom of the bag 6. By adjusting the position of the bottom positioning guide 9, the bucket conveyor 1 can be conformed to bags having different lengths. With the bag 6 positioned by the side positioning guides 7 and 8 and the bottom positioning guide 9, the driving pulley 1*c* rotates in the direction of arrow A and the bucket conveyor 1 conveys the bag 6 to the article insertion station 2. At this time, the bottom positioning guide 9 moves toward the article insertion station 2 in synchronization with the bucket conveyor 1, whereby the bag 6 is conveyed to the article insertion station 2 in a reliably positioned state.

When the bag 6 is stopped at the article insertion station 2, a plurality of suction cups 10 lift the upper side of the open end portion of the bag 6 and a plurality of suction cups 15 hold the lower side of the same, whereby the open end of the bag 6 is opened wide. Then a plurality of retainers 14 move into the open end portion of the bag 6 and retain the lower side of the same to prevent the lower side of the open end portion from being turned up. In this state, an article 12 which is a web roll in this particular embodiment is inserted into the bag 6 through the open end. That is, an article conveyor 18 and pusher 13 are provided at the article insertion station 2, and the article 12 is conveyed toward the bag 6 on the bucket conveyor 1 in the direction of arrow B with opposite sides of the article 12 supported by a pair of side plates 11 provided on the pusher 13. Thereafter the pusher 13 pushes the article 12 into the bag 6 through the open end which has been opened wide. The article conveyor 18 is inclined downward toward the bucket conveyor 1 and also the bucket conveyor 1 is inclined downward toward the bottom of the bag 6. Thus the article 12 is reliably inserted to the bottom of the bag 6. As the article 12 is forced into the bag 6, the bottom of the bag 6 is expanded as shown by the chained line in FIG. 1. In response to insertion of the article 12 into the bag 6, a bottom end portion forming member 16 moves toward the bottom end portion of the bag 6 as shown by arrow D and forms it into a predetermined shape and at the same time a bottom positioning member 16*a* moves toward the bottom end portion of the bag 6 as shown by arrow C and supports the lower portion of the bottom of the bag 6. After forming the bottom end portion, the bottom end portion forming member 16 is retracted away from the bag 6 leaving there the bottom positioning member 16*a*.

After the pusher 13 is retracted, the retainers 14 are removed from the bag 6 and the suction cups 10 and 15 release the bag 6, the bucket conveyor 1 is driven again and conveys the bag 6 with the article 12 therein to the open end portion forming station 3. At this time, the bottom positioning member 16*a* moves to the open end portion forming station 3 in synchronization with the bucket conveyor 1 while positioning the bottom of the bag 6. That is, the bottom portion forming member 16, the bottom positioning member 16*a* and the bottom positioning guide 9 are supported on a carriage 17 which is movable in parallel to the bucket conveyor 1, and are moved back and forth together with the carriage 17 as shown by double-headed arrow E. More particularly, when the bottom positioning member 16*a* is moved to the open end portion forming station 3 following the bag 6 with the article 12 therein, the bottom positioning guide 9 is moved to the article insertion station 2 following another bag 6 which is empty at this time.

When the suction cups 10 lift the upper side of the open end portion of said another bag 6, the suction cups 15 hold the lower side of the same and the retainers 14 retain the lower side of the same, the carriage 17 moves back and returns the bottom end portion forming member 16, the bottom positioning member 16*a* and the bottom positioning guide 9 to the positions shown in FIG. 1.

A bottom positioning belt 53 is passed around a two-step pulley 52 and a pulley 55 and extends from the open end portion forming station 3, through the first open end portion folding station 4 and the second open end portion folding station 5. The bottom positioning belt 53 is moved in synchronization with the bucket conveyor 1 by a driving motor 51 by way of a driving belt 54 and guides the bottom of the bag 6 from the open end portion forming station 3 to the second open end portion folding station 5.

Figure 2:
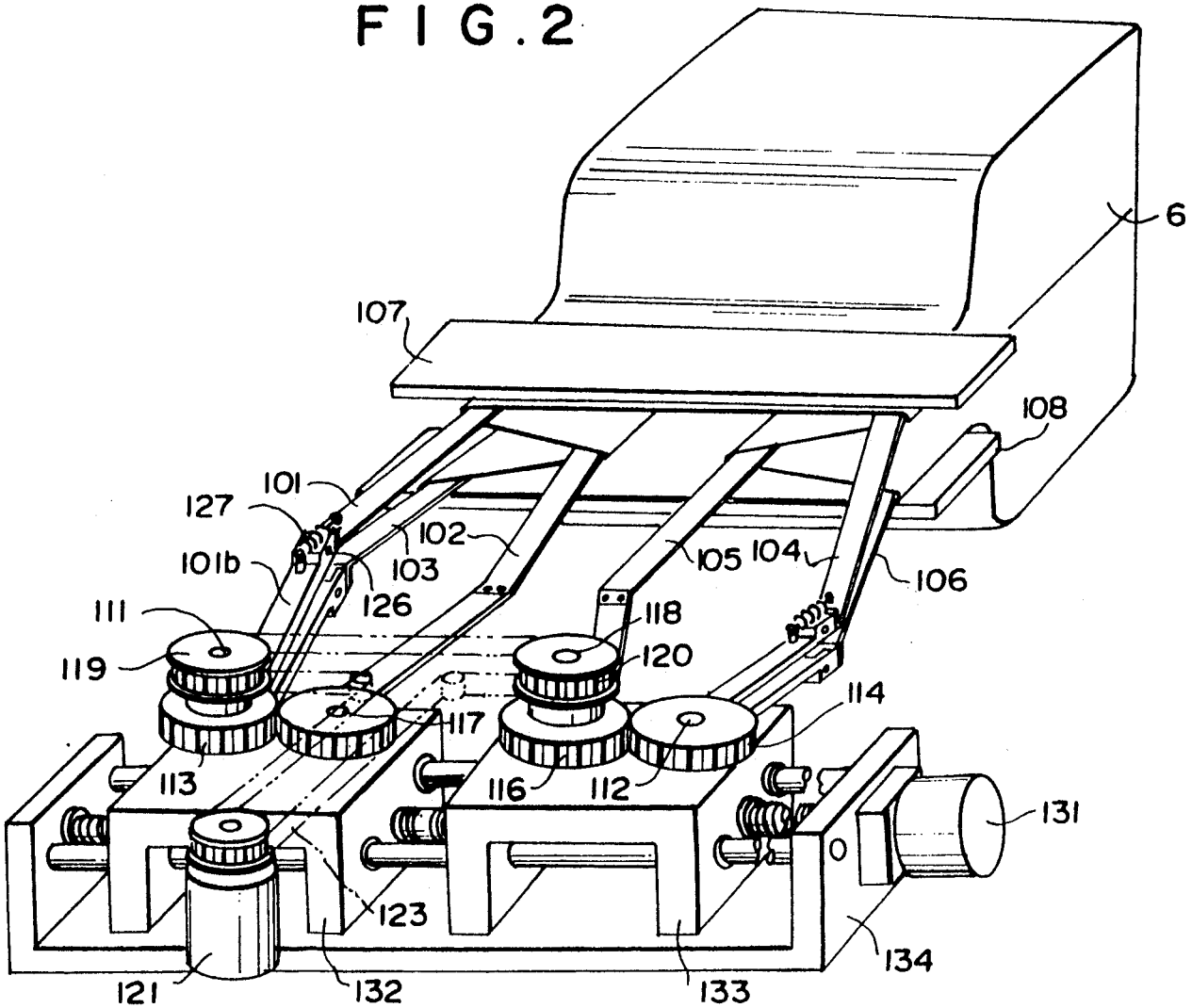
FIG. 2 is an enlarged fragmentary perspective view of the open end portion forming station of the apparatus.
Figure 3:
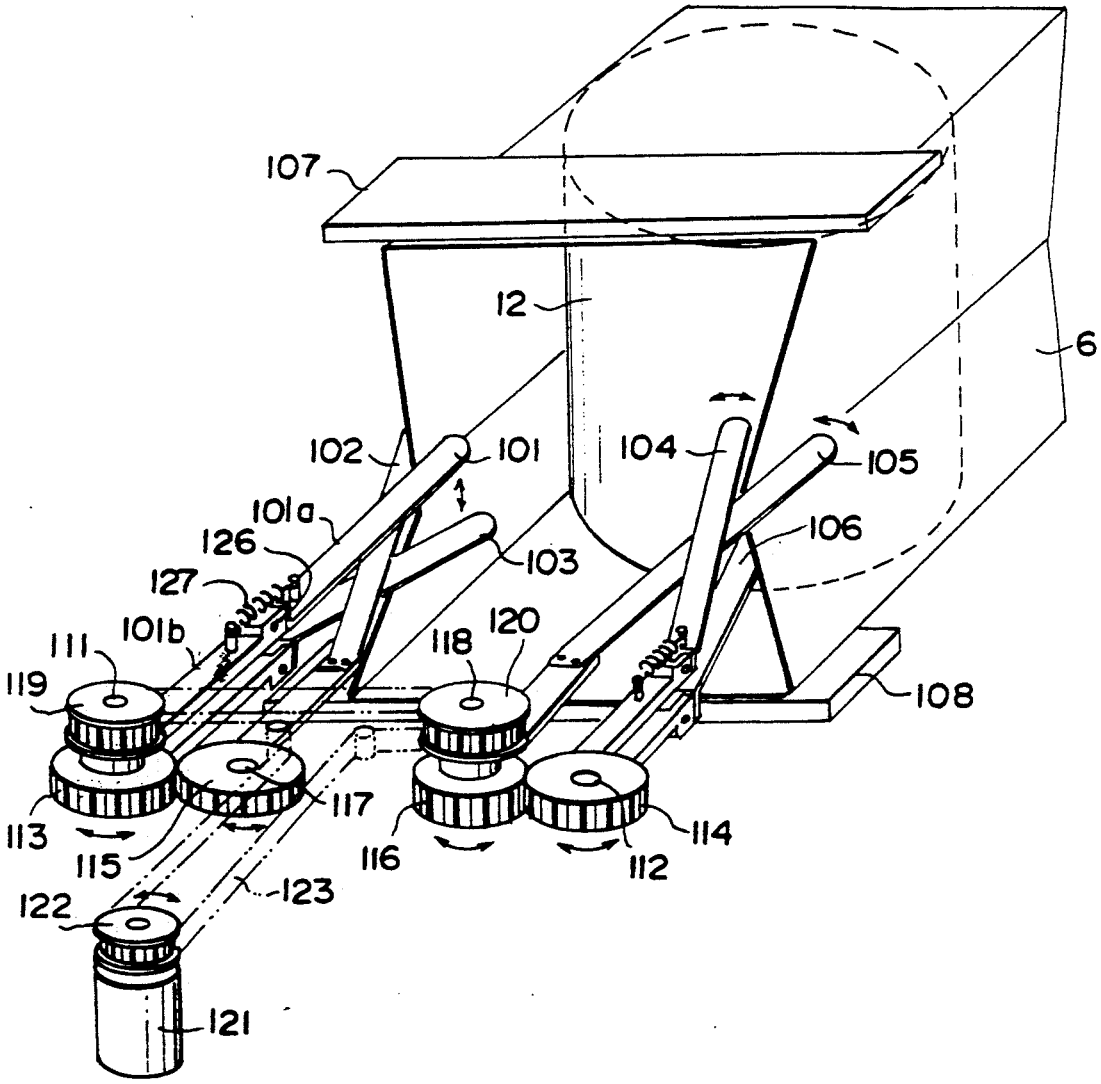
FIG. 3 is a view similar to FIG. 2 but showing a different state of the open end portion forming station.

The open end portion forming station 3 comprises, as best shown in FIGS. 2 and 3 a pair of pressing plates 107 and 108 and first to sixth forming arms 101 to 106 which are interlocked with each other. The first to third forming arms 101 to 103 are for forming the left side portion of the open end portion of the bag 6 and the fourth to sixth forming arms 104 to 106 are for forming the right side portion of the same. The first and third forming arms 101 and 103 are fixed to a first rotary shaft 111 and the second forming arm 102 is fixed to a second rotary shaft 117. A gear 113 is coaxially fixed to the first rotary shaft 111 and is in mesh with a gear 115 which is coaxially fixed to the second rotary shaft 117. The first and third forming arms 101 and 103 extend substantially horizontally and are vertically spaced from each other. The second forming arm 102 extends substantially horizontally between the first and third forming arms 101 and 103. The fourth and sixth forming arms 104 and 106 are fixed to a third rotary shaft 112 and the fifth forming arm 105 is fixed to a fourth rotary shaft 118. A gear 114 is coaxially fixed to the third rotary shaft 112 and is in mesh with a gear 116 which is coaxially fixed to the fourth rotary shaft 118. The fourth and sixth forming arms 104 and 106 extend substantially horizontally and are vertically spaced from each other. The fifth forming arm 105 extends substantially horizontally between the fourth and sixth forming arms 104 and 106.

A toothed pulley 119 is fixed to the first rotary shaft 111 above the gear 113 and a toothed pulley 120 is fixed to the fourth rotary shaft 118 above the gear 116. A driving belt 123 is passed around the toothed pulleys 119 and 120 and a toothed pulley 122 fixed to an actuating rotary shaft 121.

The first forming arm 101 is formed of a free end portion 101*a* and a base portion 101*b* fixed to the first rotary shaft 111 at one end. The free end portion 101*a* is connected to the other end of the base portion 101*b* by a hinge 126 which permits the free end portion 101*a* to bend downward relative to the base portion 101*b* and is urged upward by a spring 127. The third, fourth and sixth forming arms 103, 104 and 106 are of the similar structure except that the third and sixth forming arms 103 and 106 are arranged so that the free end portion can bend upward and is urged downward.

The first and second rotary shafts 111 and 117 are mounted on a first carriage 132 and the third and fourth rotary shafts 112 and 118 are mounted on a second carriage 133. The first and second carriages 132 and 133 are supported by a frame 134 so that they can be moved toward and away from each other by turning a knob 131.

The operation of the forming arms 101 to 106 will be described with reference to FIGS. 4*a* to 5*b*, hereinbelow.

Figure 4A:
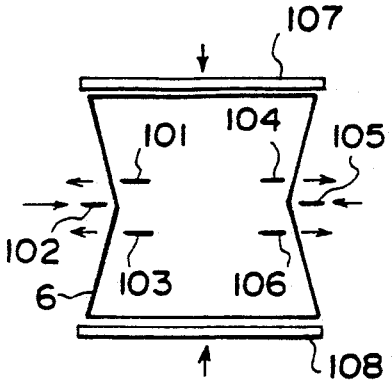
FIGS. 4*a* to 4*c* are schematic views for illustrating the operation of the open end portion forming station.
Figure 4B:
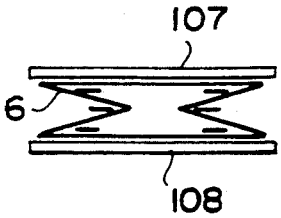
Figure 4C:
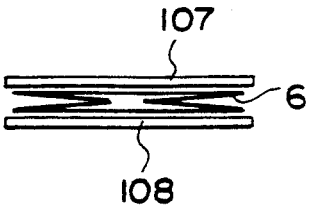
Figure 5A:
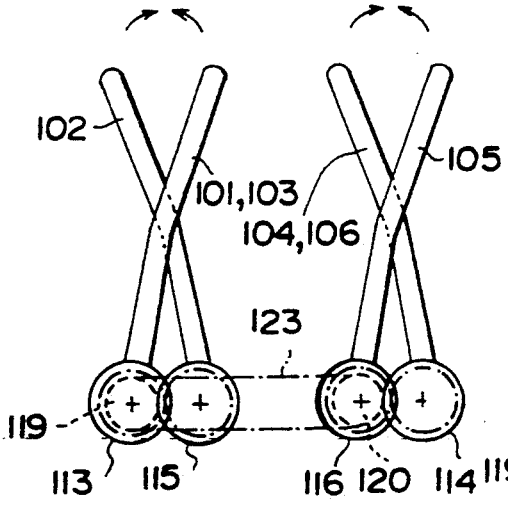
FIGS. 5*a* and 5*b* are schematic views for illustrating the movement of the forming arms.
Figure 5B:
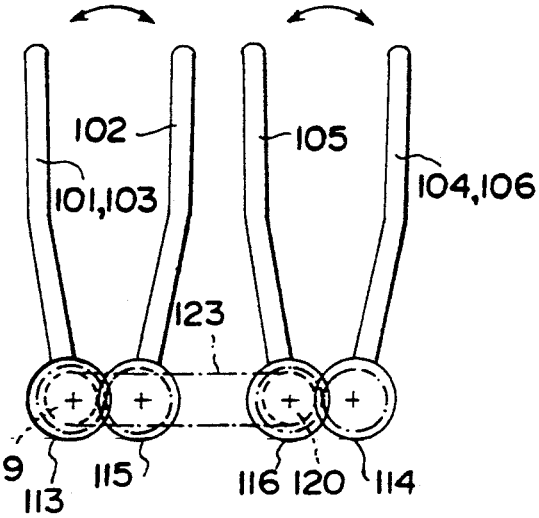

When the bag 6 with the article 12 therein is stopped at the open end portion forming station 3, the forming arms 101 to 106 are moved toward the bag 6 so that the first and third forming arms 101 and 103 are positioned inside the left side portion of the open end portion of the bag 6 with the second forming arm 102 positioned outside the same in a scissor-like fashion, and the fourth and sixth forming arms 104 and 106 are positioned inside the right side portion of the open end portion of the bag 6 with the fifth forming arm 105 positioned outside the same in a scissor-like fashion as shown in FIGS. 3 and 4*a*. FIG. 5*a* shows the relative positions of the arms 101 to 106 at that time. Then the actuating rotary shaft 121 counterclockwisely (as seen in FIG. 2) rotates by a predetermined angle. When the actuating rotary shaft 121 counterclockwisely rotates, the first and fourth rotary shafts 111 and 118 are rotated in the counterclockwise direction by way of driving belt 123 passed around the toothed pulleys 119 and 120 while the second and third rotary shafts 117 and 112 are rotated in the clockwise direction by way of the gears 113 and 116 which are respectively in mesh with the gears 115 and 114. As a result, the second forming arm 102 moves inward pulling inward the central portion of the left side portion of the open end portion and the first and third forming arms 101 and 103 move outward pulling outward the upper and lower portions of the left side portion of the open end portion, and at the same time, the fifth forming arm 105 moves inward pulling inward the central portion of the right side portion of the open end portion and the fourth and sixth forming arms 104 and 106 move outward pulling outward the upper and lower portions of the right side portion of the open end portion as shown in FIGS. 2 and 4*b*. In response to the rotation of the actuating rotary shaft 121 the pressing plate 107 moves downward and the pressing plate 8 moves upward, thereby flattening the open end portion of the bag 6 as shown in FIG. 4*c*. FIG. 5*b* shows the relative positions of the arms 101 to 106 at that time. Thereafter the forming arms 101 to 106 are retracted and drawn away from the bag 6. When the pressing plates 107 and 108 flatten the open end portion of the bag 6, the first, third, fourth and sixth forming arms 101, 103, 104 and 106 are forced toward the second or fifth forming arm 102 or 105. Said hinged structure of the forming arms permits such movements of the first, third, fourth and sixth forming arms 101, 103, 104 and 106.

The open end portion forming station 3 in accordance with this embodiment can be conformed to bags having different sizes by changing the space between the first and second carriages 132 and 133 and by changing the angle by which the actuating rotary shaft 121 rotates.

After the open end portion of the bag 6 is thus formed, the bucket conveyor 1 conveys the bag 6 to the first open end portion folding station 4. At this time, the bottom positioning belt 53 is moved in synchronization with the bucket conveyor 1 as described above and holds the bottom of the bag 6 in place.

Figure 6:
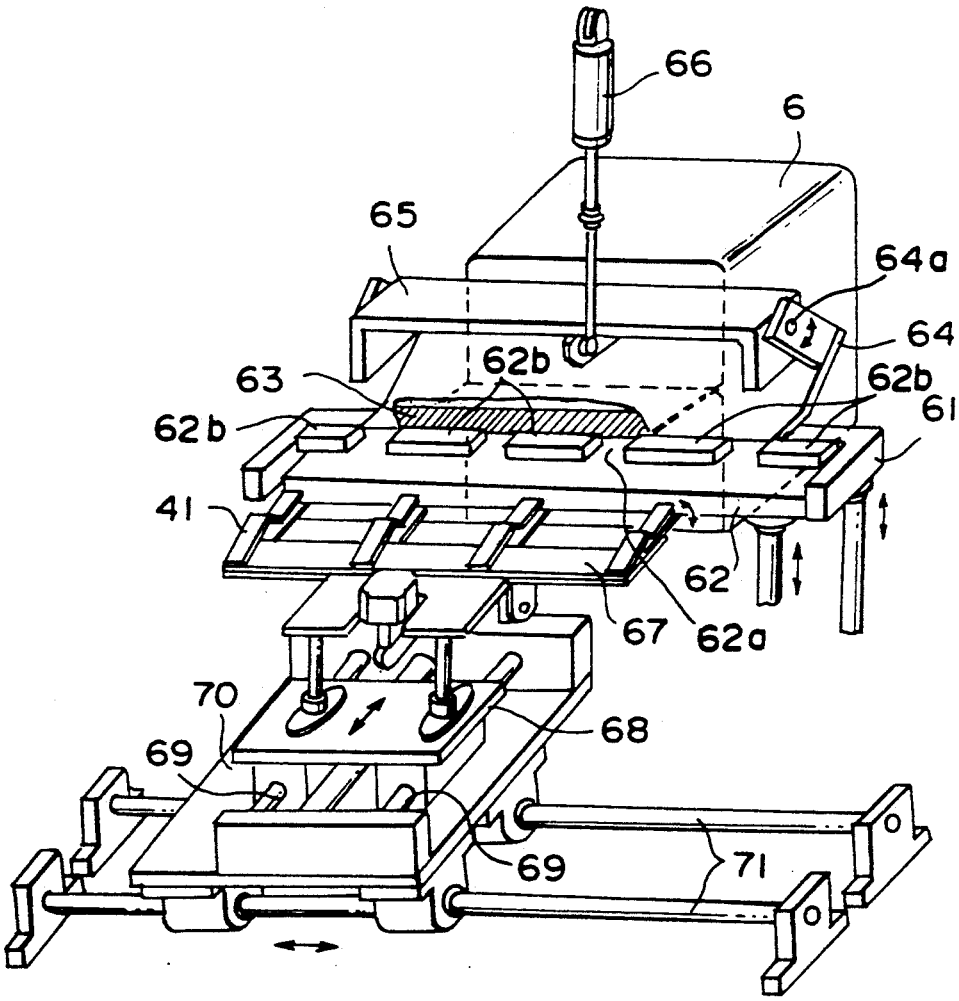
FIG. 6 is an enlarged fragmentary perspective view of the open end portion folding station of the apparatus.
Figure 7A:
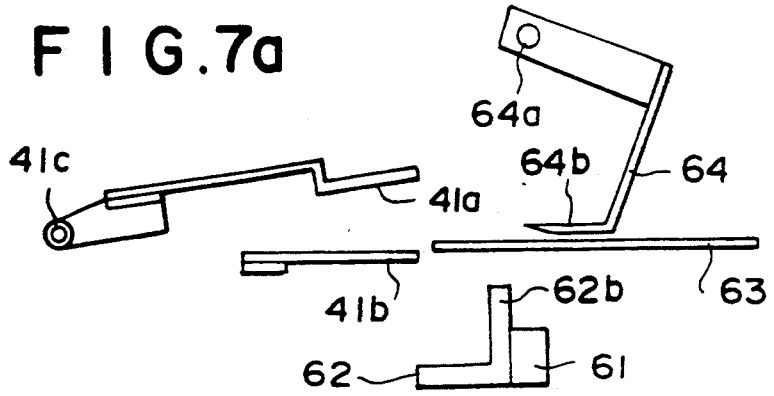
FIGS. 7*a* to 7*d* are schematic views for illustrating the operation of the open end portion folding station.

As shown in FIG. 6, at the first open end portion folding station 4, an abutment plate 64 is supported on a support member 65 for rotation about a rotary shaft 64*a* which is connected to a cylinder 66 and is driven by the cylinder 66 to rotate the abutment plate 64. When the bag 6 is stopped at the first open end portion folding station 4, the abutment plate 64 is rotated downward and the free end portion 64*b* of the abutment plate 64 rests on the upper surface of the open end portion (indicated at 63 in FIGS. 6 and 7*a* to 7*d*) of the bag 6 which has been flattened so that the free end portion (indicated at 63*a* in FIGS. 6 and 7*a* to 7*d*) of the open end portion 63 projects beyond the free end portion 64*b* of the abutment plate 64, as shown in FIG. 7*a*.

First and second folding guide members 61 and 62 are disposed below the abutment plate 64. The first folding guide member 61 has a horizontal upper surface and the second folding guide member 62 has a plurality of protrusions 62*b* which project upward and are spaced from each other. The first and second folding guide members 61 and 62 are combined so that the upper surface of the first folding guide member 61 and each of the protrusions 62*b* of the second folding guide member 62 form an L-shaped shoulder as shown in FIGS. 7*a* to 7*d*.

Figure 7B:
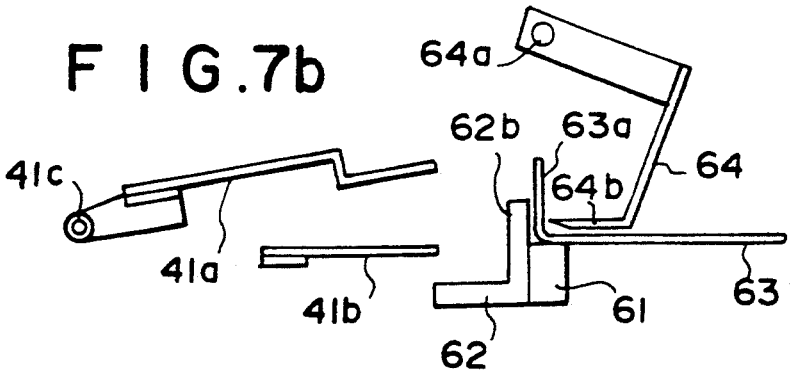

After the free end portion 64*b* of the abutment plate 64 rests on the upper surface of the open end portion 63 in the manner described above, the first and second folding guide members 61 and 62 move upward and the free end portion 63*a* of the open end portion 63 is bent upward as shown in FIG. 7*b*.

A plurality of clamps 41 each comprising upper and lower clamp members 41*a* and 41*b* as shown in FIGS. 7*a* to 7*d* are mounted on a clamp support table 67 spaced from each other in the direction of width of the open end portion 63 of the bag 6. Each upper clamp member 41*a* is supported for rotation about a rotary shaft 41*c*. The clamp support table 67 is mounted on a movable table 68 which is movable along guide shafts 69 toward and away from the open end portion 63. The movable table 68 and the guide shafts 69 are mounted on another movable table 70 which is movable along guide shafts 71 which extend in parallel to the bucket conveyor 1.

Figure 7C:
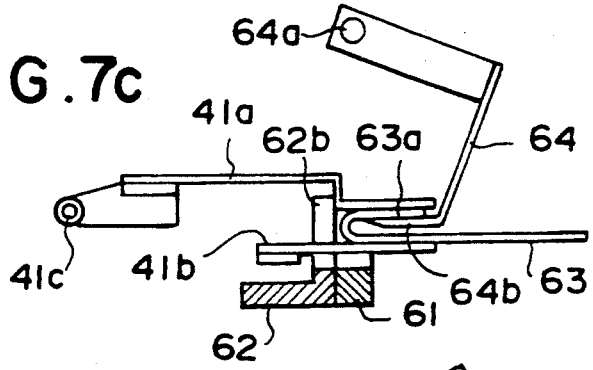
Figure 7D:
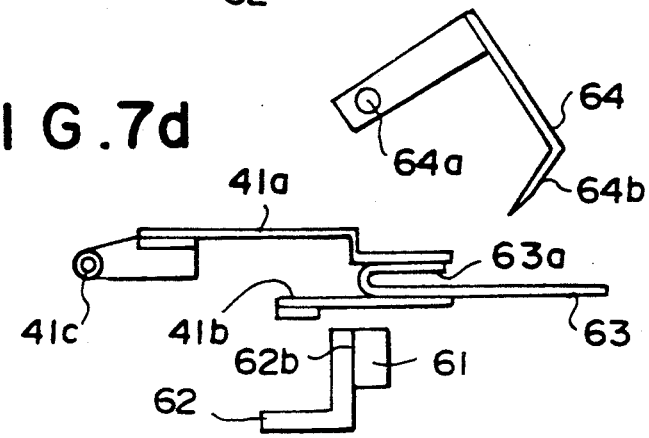

After the free end portion 63*a* of the open end portion 63 is bent upward, the clamp support table 67 is moved toward the open end portion 63 of the bag 6 and the clamps 41 are passed through the spaces 62*a* (FIG. 6) between the protrusions 62*b* of the second folding guide member 62. The lower clamp members 41*b* moves along the lower surface of the open end portion 63 while the upper clamp members 41*a* are rotated downward about the rotary shaft 41*c*, whereby the free end portion 63*a* of the open end portion 63 is folded over the free end portion 64*b* of the abutment plate 64 as shown in FIG. 7*c*. Thus the free end portion 63 of the bag 6 is folded in two. Thereafter the abutment member 64 returns to the original position as shown in FIG. 7*d*. Since a plurality of clamps 41 are provided in this particular embodiment, the open end portion folding station 4 can fold the open end portion of the bags of different sizes without changing the space between the clamps 41.

Thereafter, the bucket conveyor 1 is driven again and conveys the bag 6 to the second open end portion folding station 5. At this time, the bottom positioning belt 53 is moved in synchronization with the bucket conveyor 1 and at the same time, the movable table 70 moves to the second open end portion folding station 5 in synchronization with the bucket conveyor 1 with the folded end portion of the bag 6 kept sandwiched between the upper and lower clap members 41*a* and 41*b*. Thus the folding operation at the second open end portion folding station 5 is facilitated.

The second open end portion folding station 5 is similar to the first open end portion folding station 4 and folds the open end portion once more.

Then the folded open end portion is bonded to the front face of the bag 6 by adhesive.

As can be understood from the description above, the bagging apparatus of this embodiment can fold the open end portion of the bag 6 to present a good appearance. Further, the bagging apparatus of this embodiment is advantageous in that it can conform to bags having different sizes without requiring troublesome operation.

The bagging apparatus of the embodiment described above may be modified in various ways. For example, though, in the embodiment described above, the upper and lower side of the bag 6 are separated away from the each other by suction cups only at the open end portion, they may be separated also at a portion near the bottom, whereby the article can be inserted into the bag 6 more smoothly and the surface of the article can be prevented from being scratched. Further when the open end portion forming station has a means for holding the gusset of the bag 6, the open end portion of the bag 6 can be formed more positively.

What is claimed is:

1. An apparatus for filling an article into a bag having an open end and a closed end comprising an article insertion station which inserts the article into the bag thought the open end thereof, an open end portion forming station which forms the open end portion of the bag into a predetermined shape, an open end portion folding station which folds the formed opened end portion of the bag, and a conveyor means which conveys the bag in a sequence from a bag feeding station to the article insertion station, then to the open end portion forming station, and then to the open end portion folding station characterized in that said conveyor means conveys the bag with its open end and closed end directed transversely to the bag conveying direction of the conveyor means and said article insertion station includes means for inserting the article in a direction transverse to the bag conveying direction of the conveyor means said conveyor means is a bucket conveyor comprising a pair of flexible belts which are arranged side by side and are driven in the same direction in synchronization with each other, and a first side positioning member which positions one side of the bag relative to the bucket conveyor in the longitudinal direction thereof is provided on one of the flexible belts and a second side positioning member which positions the side of the bag opposite to said one side relative to the bucket conveyor in the longitudinal direction thereof is provided on the other flexible belt so that a space between the first and second side positioning members can be adjusted by moving the flexible belts relative to each other in the bag conveying direction said bucket conveyor is provided with a bottom positioning member which abuts against the closed end of the bag to position the bag relative to the bucket conveyor in a transverse direction of the bucket conveyor, the bottom positioning member being supported separately from the bucket conveyor by a means for reciprocating said bottom positioning member along the bucket conveyor between the bag feeding station and the article insertion station in synchronization with the bucket conveyor transporting the bag to the article insertion station.

2. An apparatus as defined in claim 1 in which said bottom positioning member is supported so that its position can be changed in the transverse direction of the bucket conveyor.

3. An apparatus as defined in claim 1 in which said bucket conveyor is further provided with a second bottom positioning means which is opposed to the article insertion station and positions the closed end of the bag in the transverse direction of the bucket conveyor after the article is inserted into the bag.

4. An apparatus as defined in claim 3 in which said second bottom positioning means is supported separately from the bucket conveyor by a means for moving said second positioning means back and forth along the bucket conveyor between the article insertion station and the open end portion forming station and in synchronization with the bucket conveyor transporting the bag to the open end portion forming station.

5. An apparatus as defined in claim 4 in which a bottom positioning belt is provided to extend along the bucket conveyor from the open end portion forming station to the open end portion folding station and is moved in synchronization with the bucket conveyor while positioning the closed end of the bag in the transverse direction of the bucket conveyor.

6. An apparatus as defined in claim 1 in which said open end portion forming station comprises left and right side forming means which respectively form a left and a right side portion of the open end portion of the bag which has been opened wide, each of the side forming means comprises upper, middle and lower forming arms, the upper and lower forming arms being adapted to abut against the inside surface of the left and the right side portion and push outward the left and the right side portion and the middle forming arm being adapted to abut against the outer surface of the left and the right side portion between the upper and lower forming arms and push inward the left and the right side portion.

7. An apparatus as defined in claim 6 in which said open end portion forming station further comprises a pair of pressing plate members which press therebetween the open end portion of the bag which has been formed by said forming arms.

8. An apparatus as defined in claim 1 further comprising a left side forming means comprising upper and lower forming arms adapted to abut against an inside surface of a left side portion of the open end portion of the bag which has been opened wide and push outward the left side portion, and a middle forming arm adapted to abut against an outer surface of the left side portion between the upper and lower forming arms and push inward the left side portion, and a right side forming means comprising upper and lower forming arms adapted to abut against the inside surface of a right side portion of the open end portion of the bag which has been opened wide and push outward the right side portion, and a middle forming arm adapted to abut against the outer surface of the right side portion between the upper and lower forming arms and push inward the right side portion.

9. An apparatus as defined in claim 8 further comprising a pair of pressing plate members which press therebetween the open end portion of the bag which has been formed by said left and right side forming means.

10. An apparatus as defined in claim 1 in which said conveyor means is an intermittent conveyor that stops the bag at each of the stations, and in which said conveyor means is driven between each of the stations in synchronization with the sequence.

* * * * *